US006020823A

United States Patent [19]

DeCicco

[11] Patent Number: 6,020,823

[45] Date of Patent: Feb. 1, 2000

[54] DECORATIVE PACKAGING WITH SPECIAL EFFECTS

[76] Inventor: Richard J. DeCicco, 3379 Jason Ct., Bellmore, N.Y. 11710

[21] Appl. No.: 09/114,038

[22] Filed: Jul. 10, 1998

[51] Int. Cl.[7] ..... B08B 3/00

[52] U.S. Cl. ..... 340/691.2; 340/691.4; 340/692; 340/384.7; 340/815.69; 206/459.1; 206/497; 215/390; 220/DIG. 16; 224/414; 229/89

[58] Field of Search ..... 340/691.2, 692, 340/384.1, 384.7, 815.69, 815.7, 691.4; 229/89; 206/459.1, 497; 220/DIG. 16, 737–739; 224/414; 215/390, 381

[56] References Cited

U.S. PATENT DOCUMENTS

| | | | |
|---|---|---|---|
| 2,166,513 | 7/1939 | Waters | 428/142 |
| 4,652,980 | 3/1987 | Segan | 362/86 |
| 4,811,896 | 3/1989 | Sohma | 229/89 |
| 4,930,902 | 6/1990 | Yata et al. | 374/150 |
| 5,163,447 | 11/1992 | Lyons | 128/844 |
| 5,344,034 | 9/1994 | Eagan | 215/11.1 |
| 5,419,563 | 5/1995 | Abrams et al. | 273/187.5 |
| 5,575,383 | 11/1996 | Seeley | 206/217 |

*Primary Examiner*—Daniel J. Wu
*Attorney, Agent, or Firm*—Arthur Dresner; McAulay Nissen Goldberg Kiel & Hand, LLP

[57] ABSTRACT

A package wrap for decoratively covering a container having side walls defining an interior space for carrying a product therein, includes a flexible thin sheet of polymeric material adapted to be shrink-wrapped onto the exterior of the container. An illuminating or a sound producing device is positioned between the flexible thin sheet of polymeric material and the exterior of the container so that when the flexible sheet of polymeric material is shrink-wrapped onto the container, the illuminating device or the sound device will be held securely in place. The illuminating device is adapted to be illuminated upon activation by a pressure, motion, or acoustically sensitive switch. The sound device is adapted to produce an audible signal upon activation by a pressure or motion sensitive switch. When the illuminating device is activated, illumination therefrom will be visible through the flexible thin sheet of polymeric material to enhance and highlight a printed pattern on the exterior of the package wrap.

7 Claims, 2 Drawing Sheets

DECORATIVE PACKAGING WITH SPECIAL EFFECTS

FIELD OF THE INVENTION

This invention relates generally to the field of product packaging materials, and more particularly to such packaging materials having sources of illumination and sound in order to create special visual and audio effects for displaying products such as are marketed in glass or plastic containers, including food and drink items, or personal care items such as shampoos and conditioners.

BACKGROUND OF THE INVENTION

Decorative packaging materials, such as are used as gift wrappings during holiday seasons for a variety of items including food and drink products sold in glass or plastic containers, personal care items and gift boxes, are of course, well known in the art. Decorative wrappings or packaging heretofore used for such purposes have included paper wrappers or cardboard boxes with fanciful designs printed on their exterior. Plastic wrappings with silver or gold colored surfaces have also been used, for example on liquor bottles. Thin plastic films, made out of polyester or other polymeric material, which are used to envelop a container have also been used for creating fanciful product wrappings. The use of such polymeric films has become quite popular due to the fact that such a film can be wrapped about an item and heat treated so that it will shrink onto the container about which it is being wrapped, thus creating a snug fitting wrapping on the container. This procedure is commonly referred to as "shrink-wrapping." Shrink-wrapped packaging is particularly advantageous when packaging and displaying two or more items together. The use of such plastic films has also become popular due to the fact that fanciful designs and messages can be printed on the exterior of the film to create holiday pictorial artwork and theme messages. The use of such shrink-wrapped packaging materials, however, has had limitations. The visual effects that have heretofore been available have been limited to printed matter, including color images and other fanciful and artistic designs which are printed on sheets of thin film on thin paper used as wrappings. It has been common to shrink-wrap thin plastic films onto such items as liquor bottles, soda bottles, iced tea bottles and other drink related or personal care items in order to package such items with other articles, including booklets, cups, etc. Attracting attention to such packaged goods for more effective marketing is the goal of every merchandising manager. Colored bows and ribbons are sometimes also used for this purpose. However, it would be desirable to create special visual and audio effects with shrink-wrapping and other wrapping materials that could be capable of attracting the attention of a shopping consumer or to create a more effective decorative appearance.

It is accordingly a principal object of the present invention to provide an improved type of decorative packaging using shrink-wrappable plastic films.

A further object of the present invention is to provide, in combination with a shrink-wrappable plastic film or other package wrap, means for creating audible sounds and illuminated visual effects.

Yet a further, more specific object of the present invention is to provide a shrink-wrapping film that can be used for packaging a variety of articles, including bottles, with means that can be illuminated to create a decorative visual effect when the package is subjected to certain initiating means, such as movement, sound or pressure.

Another object of the invention is to provide a package wrap with devices that produce a variety audible of sounds or that can be illuminated in order to highlight certain aspects or areas on a decorative design of the package.

The above objects, features and advantages, along with other objects, features, and advantages will become more apparent from the detailed description of the invention in connection with the accompanying drawings to be described more fully hereinafter.

BRIEF DESCRIPTION

A package wrapping for decoratively covering a product container includes a shrinkwrappable plastic film and special effects electronic devices, including illuminating devices such as light emitting diodes and sound chips which can be positioned between the film and the container and thereby held in place when the film is heated and shrink-wrapped onto the container. A source of electrical energy, such as a battery, is connected to the light emitting diodes or sound chip for energizing the light emitting diodes or sound chip and causing them to become illuminated or produce certain sounds. Switch means are also provided for connecting the light emitting diodes or sound chips with the source of energy when the switch is activated. Illuminating devices or sound producing devices which encapsulate within a housing a light emitting diode or sound chip, a source of voltage for energizing the diode and switch means are commercially available.

BRIEF DESCRIPTION OF THE DRAWINGS

The foregoing and other features of the present invention are more fully described with reference to the following drawings annexed hereto.

DESCRIPTION OF THE INVENTION

Figure 1:
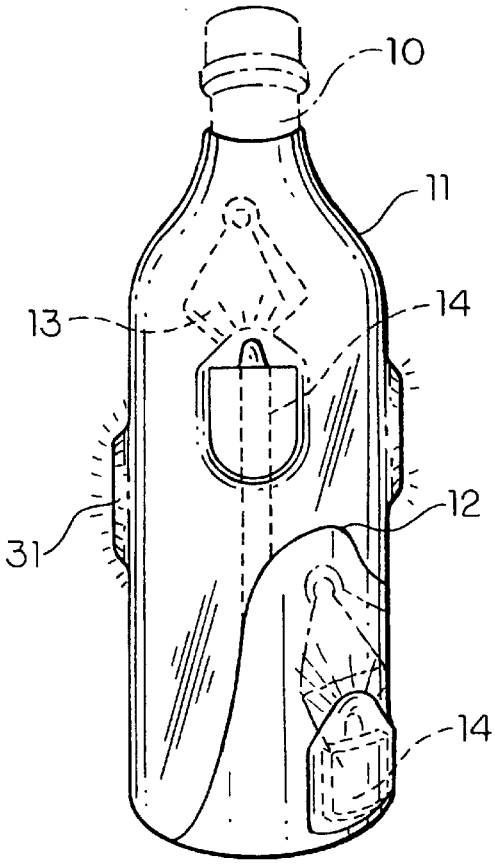
FIG. 1 is a perspective view of a bottle with the shrink-wrapping package according to the present invention applied thereto.
Figure 2:
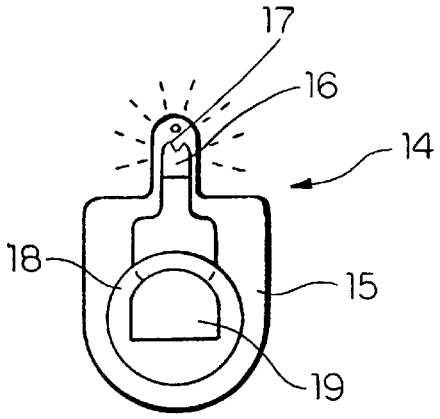
FIG. 2 is a schematic representation of an illuminating device used in connection with the present invention.

With reference to FIG. 1, a container 10, such as a bottle for soft drinks, hard drinks, or personal care items, is illustrated. A thin film 11 made of polymeric material such as polyester, polyvinyl chloride, polyethylene terepthalate or glycol modified polyethylene terpthalate, and having a thickness ranging from about one half to ten millimeters, but preferably from about one to five millimeters is wrapped about the bottle 10. Bottle 10 can be made of glass or plastic and has side walls which define an interior space for carrying a liquid product. The film 11 may have a fanciful or colored design 12 printed on its exterior surface. In the embodiment illustrated, the decorative design includes a pictorial representation of a street lamp 13. Illuminating devices 14 are positioned beneath the film 11, between the film 11 and the outer surface of the side walls of bottle 10. With reference to FIG. 2, which schematically illustrates one type of illuminating device, each illuminating device 14 includes a plastic molded housing 15 and at least one light emitting diode 16 encapsulated within a transparent or translucent tube 17 carried by the housing 15. A sensory switch 18 carried by the housing 15 is electrically connected between a source of voltage 19, also carried by the housing, and the light emitting diode 16. When switch 18 is closed, the source of voltage 19 will energize the light emitting diode causing it to become illuminated. The housing 15 encapsulates the light emitting diode, the switch, and the source of voltage. Illuminating devices of this type are commercially available from the Marpol Company of Hong Kong. One example of a known illuminating device is described and illustrated in U.S. Pat. No. 5,188,447. The illuminating device described in the foregoing patent includes a piezoelectric member which produces a signal when a strain such as may be caused by pressure is applied to the piezoelectric member. The signal from the piezoelectric member is amplified, causing a light emitting diode to be energized by a power supply connected between the piezoelectric member and the light emitting diodes. Accordingly, sensory switch 18 can be pressure activated by a piezoelectric member which produces the required electrical signal when pressure of a predetermined magnitude is applied to it.

Illuminating device 14 is located between the film 11 and the outer surface of bottle 10 in the areas of design 12 on the film 11 which depict items to be illuminated, such as the street lamps 13. When the surface of the film is touched in the area of the street lamp and pressure at or above the predetermined magnitude is applied to the illuminating device 14, switch 18 will close and light emitting diode 16 will become illuminated and will be visible through the film 11, thus causing the effect of an illuminated street lamp. In a preferred embodiment, the illuminating devices 14 are secured to the inside surface of the film 11, such as by an adhesive. In this manner, film 11 which carries a plurality of illuminating devices 14 can be easily wrapped about a container such as bottle 11 so that when heat above a certain level is applied to the wrapping it will shrink onto the bottle, causing a tight fit, holding illuminating devices 14 firmly in place. Heat to produce the shrinking of the film onto the container can be applied using hot air in the range of 300–450° F., or using steam in the range of 160 to 200° F.

Figure 3:
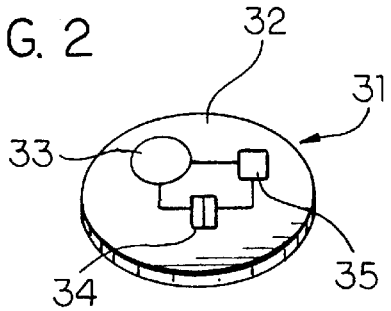
FIG. 3 is a schematic representation of a sound device used in connection with the present invention.

Sound devices 31 can also be positioned between film 11 and the outer surface of the side walls of bottle 10 and will be held in place when the film 11 is shrink wrapped onto bottle 10. Sound devices commercially available for the use described herein include a sound chip, which is an integrated circuit on a silicon wafer that produces predetermined audible sounds, such as the sound of chimes, buzzer, or combinations of sounds that produces tunes such as jingle bells, when the chip is energized by application of an appropriate voltage. The sound device also includes a source of voltage such as a battery and a sensory switch for connecting the voltage source with the sound chip when the sensory switch is activated or closed. Such sound devices are commonly available in a housing 32 which is cylindrical, such as illustrated in FIG. 3. The sound device housing 32 is typically made of molded plastic and can have a diameter of less than one inch and a height of less than one eighth inch. Devices of this type are commercially available from the Marpol Company in Hong Kong. Housing 32 will encapsulate a sound chip 33, a source of voltage 34 and a sensory switch 35. Sensory switch 35 can be of the pressure activated type described above in connection with switch 18 of illuminating device 14.

Other types of sensory switches can be used to close a circuit between a source of voltage and the light emitting diodes 16 of illuminating device 14, or the sound chip 33 of sound device 31. An example of another type of switch is a mercury switch, which will cause a circuit to close upon movement of the housing of the illuminating or sound device. Such motion activated devices are also well known in the art and are also commercially available. In addition, acoustically activated illuminating devices which become energized upon certain audio signals being applied to it may also be used so that the visual effect of a lighted street lamp will become illuminated upon certain audible sounds being generated and received by the illuminating device 14.

Figure 4:
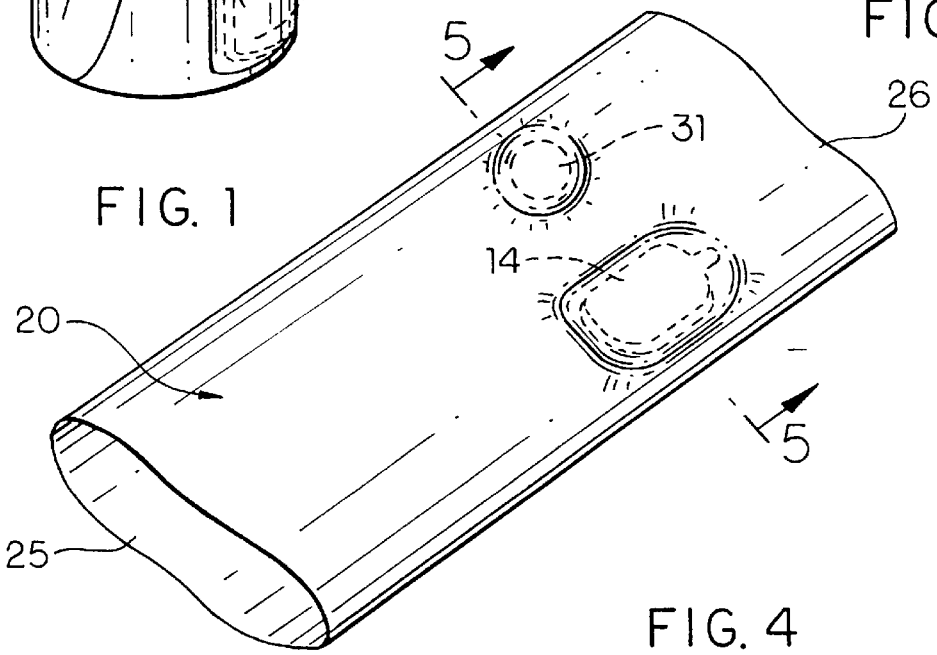
FIG. 4 is a perspective view of a tubular shaped shrink-wrappable plastic film having an illuminating device and a sound device carried thereby.
Figure 5:
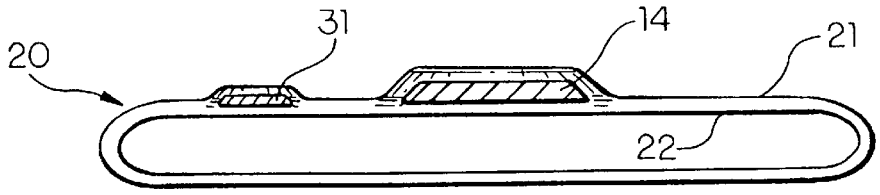
FIG. 5 is a sectional view taken along lines 5—5 of FIG. 4.

Referring now to FIG. 4, another embodiment of the present invention is illustrated. In this embodiment, a sleeve 20 which is formed by a flexible thin plastic film, having a thickness of between 1 and 5 millimeters carries a plurality of illuminating devices 14 or sound devices 31. Only one of each type of such device is illustrated. The sleeve 20 has a tubular configuration open at both ends 25 and 26 so that it may be placed over a container to be wrapped. The exterior surface of the sleeves can be printed with a fanciful pattern or design. Illuminating devices 14 and sound devices 31 are secured to the interior surface of the sleeve 20 either by an adhesive or in the manner illustrated in FIG. 5. In FIG. 5, illuminating devices 14 and sound devices 31 are sandwiched between two films 21 and 22 so that they will be held firmly in place. Sleeves 20 can be shrink-wrapped onto a variety of containers for use as a decorative package wrap. When the illuminating devices are energized they will become illuminated and visible through the sleeve 20 in order to highlight certain areas of the printed pattern. When the sound devices are energized they will produce the predetermined audible sounds or jingles. Sleeves 20 can be marketed to the consumer, who, with a common household hair dryer can supply a sufficient amount of heat to the film to cause it to shrink onto the package to which it is being applied.

Figure 6:
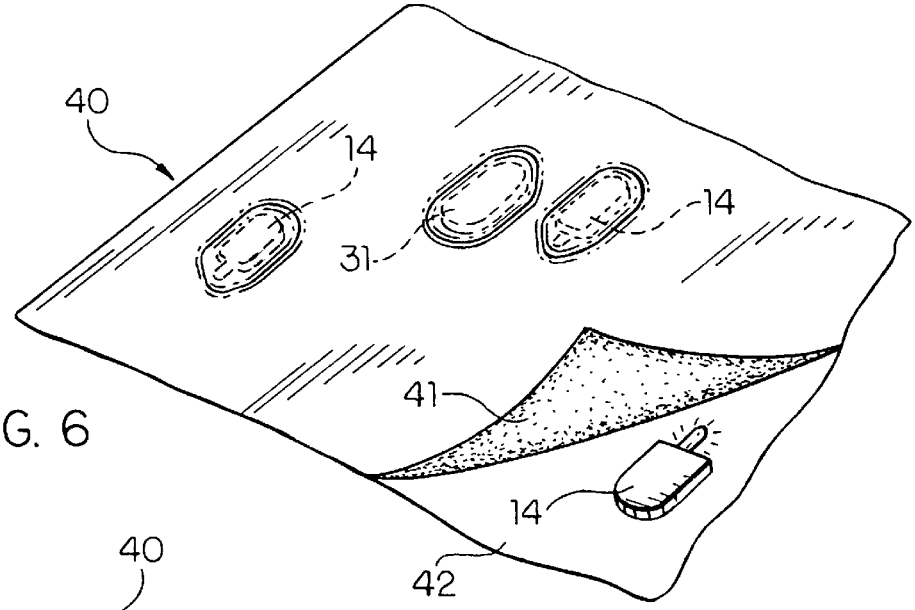
FIG. 6 is a partial exploded perspective view of another embodiment of the invention.
Figure 7:
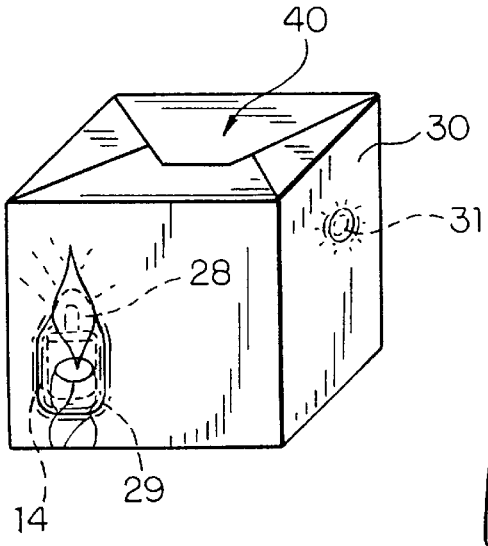
FIG. 7 is a perspective view of a box container with the package wrap according to the embodiment of FIG. 6.

The embodiment of FIG. 6 is a two ply sheet 40 of either shrink-wrappable plastic film, thin paper or any other type of wrapping material. Sheet 40 has a first ply 41 and second ply 42. Sound devices 31 or illuminating devices 14 are sandwiched between plies 41 and 42 and can be secured in place by an adhesive. Plies 41 and 42 can also be laminated together or secured together by an adhesive. Sheets 40 can be used to wrap any type of container, such as box 30 shown in FIG. 7, and secured in place in any usual manner, for example with tape or shrink-wrapped if shrink wrappable material is used. The sheet 40 can also be supplied with a design 29, such as a candle 28. An illuminating device 14 is placed so that the position of light emitting diode will coincide with the position of the candle 28.

Figure 8:
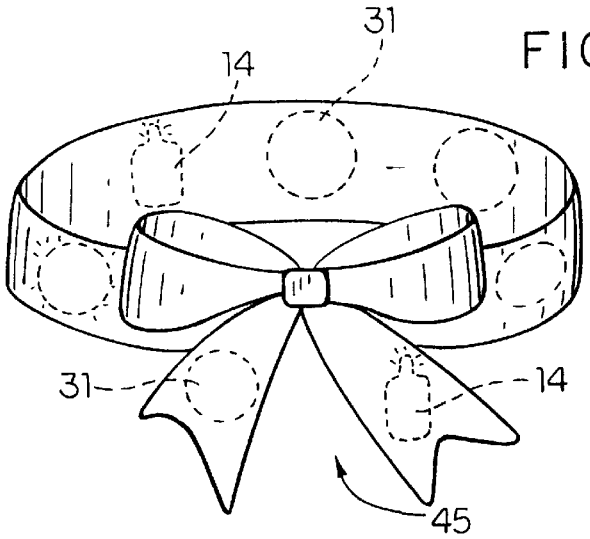
FIG. 8 is a perspective view of a further embodiment of the invention.

In another embodiment illustrated in FIG. 8, a bow 45 for use in decorating packages, carries illuminating devices 14 and/or sound devices 31. When used to decorate packages the illuminating and sound devices will create special effects.

This invention has been described and illustrated in connection with certain preferred embodiments which are illustrative of the principles of the invention. However, it should be understood that various modifications and changes may readily occur to those skilled in the art, and it is not intended to limit the invention to the construction and operation of the embodiments shown and described herein. Accordingly, additional modifications and equivalents may be considered as falling within the scope of the invention as defined by the claims herein below.

The embodiments of the invention in which an exclusive property or privilege is claimed are defined in the appended claims.

What is claimed is:

1. A package wrap for decoratively covering a container comprising: a first tubular sleeve made of thin flexible polymeric material having a thickness of between one half and ten millimeters having inside and outside surfaces, a second tubular sleeve of thin flexible polymeric material having a thickness of between one half and ten millimeters carried concentrically with and interiorly of said first tubular sleeve; a decorative pattern printed on said outside surface of said first tubular sleeve; a pluarity of special effects illuminating and sound devices sandwiched between said first and second tubular sleeves to produce illumination and audible sound effects respectively when said devices are activated, each of said illuminating devices including a light emitting diode connected to a source of voltage for energizing said light emitting diode when said light emitting diode is activated, and each of said sound devices including a sound producing integrated circuit connected to a source of voltage for energizing said sound producing integrated circuit when said sound device is activated; and means for activating said illuminating devices and said sound devices comprising a pressure sensitive or motion sensitive switch.

2. A package wrap for decoratively covering a container comprising: a sheet of wrapping material formed by first and second plies of material which are secured together, said sheet having an exterior surface and an interior surface;

a decorative pattern printed on said exterior surface of said sheet;

a pluarity of special effect illuminating devices sandwiched between said first and second plies to produce illumination visible through said sheet for highlighting areas of said printed pattern when said illuminating devices are activated, each of said illuminating devices including a light emitting diode connected to a source of voltage for energizing said light emitting diode when said light emitting diode is activated; and a pressure sensitive, motion sensitive or acoustically sensitive switch for activating said illuminating device.

3. The package wrap according to claim 2 further comprising a pluarity of special effect sound producing devices adapted to produce an audible sound when activated, each said sound device including a sound producing integrated circuit connected to a source of energizing voltage for causing said circuit to produce said sound when said device is activated, and a pressure sensitive or motion sensitive switch for activating said device.

4. A decorative package wrap comprising:

a bottle container for holding a liquid product having side walls defining an interior space for carrying said liquid product therein;

a flexible thin sheet of polymeric material consisting of polyester, polyvinyl chloride, polyethylene terepthalate or glycol modified polyethylene terepthalate adapted to be shrink-wrapped onto the exterior of said bottle container; and at least one special effect illuminating device incorporating a light emitting diode, a source of voltage connected to said light emitting diode, and a sensory switch connected between said light emitting diode and said source of voltage, said light emitting diode, said source of voltage and said sensory switch being encapsulated in a common housing, said special effect illuminating device being positioned between said flexible thin sheet of polymeric material and the exterior of said side walls of said bottle container so that when said flexible thin sheet of polymeric material is shrink-wrapped onto said container said at least one special effect illuminating device will be held securely in place;

whereby when said sensory switch is closed said light emitting diode will be activated and thereby illuminated to produce a visual special effect visible through said thin sheet of polymeric material.

5. The decorative package wrap according to claim 4 further comprising special effect a sound device for producing an audible signal upon activation positioned between said flexible thin sheet of polymeric material and the exterior of said side walls of said bottle container, said sound device including a sound chip, a source of voltage connected to said sound chip and a sensory switch connected between said sound chip and said source of voltage so that when said sensory switch is closed said sound chip will be activated to thereby produce an audible sound, said sound chip, said source of voltage and said sensory switch being encapsulated in a common housing.

6. The decorative package wrap according to claim 5 wherein said sensory switch for activating said illuminating device is pressure activated, motion activated or acoustically activated, and wherein said sensory switch for activating said sound device is pressure activated or motion activated.

7. The decorative package wrap according to claim 6 wherein said flexible thin sheet of polymeric material is a film having a thickness of between 1 and 5 millimeters.

* * * * *